US007282263B2

(12) United States Patent
Rasmusen et al.

(10) Patent No.: US 7,282,263 B2
(45) Date of Patent: Oct. 16, 2007

(54) METHOD FOR COLORING CELLULOSIC MATERIALS USING CATIONIC PIGMENT DISPERSION

(75) Inventors: Hans Rasmusen, Hvalso (DK); Jorn R. Thorsson, Virum (DK); James E. Moore, Cincinnati, OH (US); Charles W. Perry, Boiling Springs, SC (US); Joseph P. LaBazzo, Mason, OH (US)

(73) Assignee: Sun Chemical Corporation, Parsippany, NJ (US)

( * ) Notice: Subject to any disclaimer, the term of this patent is extended or adjusted under 35 U.S.C. 154(b) by 0 days.

(21) Appl. No.: 10/478,382

(22) PCT Filed: May 17, 2002

(86) PCT No.: PCT/US02/15857

§ 371 (c)(1),
(2), (4) Date: Sep. 9, 2004

(87) PCT Pub. No.: WO02/095130

PCT Pub. Date: Nov. 28, 2002

(65) Prior Publication Data

US 2005/0025972 A1 Feb. 3, 2005

(51) Int. Cl.
*B32B 5/16* (2006.01)

(52) U.S. Cl. ..... 428/403; 428/404; 428/405; 428/406; 428/407; 106/400; 106/410; 106/412; 106/411; 524/88

(58) Field of Classification Search ..... 428/403, 428/404, 405, 406, 407; 106/400, 410, 412, 106/411; 524/88
See application file for complete search history.

(56) References Cited

U.S. PATENT DOCUMENTS 4,543,128 A * 9/1985 Troesch et al. ..... 106/31.43
4,750,936 A * 6/1988 West et al. ..... 106/31.27

FOREIGN PATENT DOCUMENTS

EP 309908 B1 9/1988
JP 05-331780 5/1992

* cited by examiner

*Primary Examiner*—Leszek Kiliman
(74) *Attorney, Agent, or Firm*—Dickstein, Shapiro, LLP.

(57) ABSTRACT

A method of coloring a cellulosic material which includes a) dispersing pulped cellulosic material into water; and b) coloring the pulped cellulosic material by adding a cationic dispersion to the water, where the dispersion includes: (i) at least one pigment; (ii) water; and (iii) at least one acid salt of a styrene maleimide resin in an amount effective to disperse the pigment. The cationic dispersion may be prepared by (i) mixing, at 500 to 10,000 rpm, at least one pigment; water; and either (a) at least one acid salt of a styrene maleimide imide resin or (b) at least one styrene maleimide imide resin in combination with at least one weak acid, thereby forming a dispersion premix; (ii) milling the dispersion premix in a mixer filled with ceramic, metal or glass beads for a period of time sufficient to reduce pigment agglomerates to primary particles, thereby forming a non-standarized dispersion; and (iii) standardizing the dispersion against a color standard by adding water. The resulting cationic dispersion can be used to color cellulosic materials such as cotton and paper.

19 Claims, No Drawings

METHOD FOR COLORING CELLULOSIC MATERIALS USING CATIONIC PIGMENT DISPERSION

BACKGROUND OF THE INVENTION

1. Field of the Invention

This invention relates to a method of coloring cellulosic materials such as paper pulp and cotton. More particularly, this invention relates to a method of coloring cellulosic materials using a cationic dispersion which contains at least one pigment, water, and at least one dispersing agent comprising a acid salt of a styrene maleimide imide resin.

2. Description of the Prior Art

Papermaking is a well-known process in which a cellulosic material, typically obtained from wood, is mechanically or chemically pulped, dispersed in water, formed into a planar sheet, dried and wound onto a roll for later use. The paper may be sized to modify its surface characteristics, particularly water penetration, which is important for writing and printing grades of paper. Additives such as fillers and optical brighteners may be added to the pulp prior to sheet formation. Colorants such as dyes or pigments may also be added during the papermaking process, either by coloring the paper pulp, or applying the colorant to the paper surface by dip coating, spraying or pad printing. Pulp coloration is the most widely used type of paper coloration.

"Substantivity" is the ability of a dye or pigment to be adsorbed by cellulose fibers from an aqueous medium.

"Affinity" is the capability of a dye or pigment to be bound to cellulose fibers. Cellulosic materials are slightly anionic in water due to partly dissociated carboxylic acid and other functional groups. Some chemically treated pulps may also contain sulfonate groups.

The anionic character of cellulosic materials in water affects the substantivity and affinity of dyes and pigments for paper. Thus, anionic dyes such as acid and anionic direct dyes will typically require the addition of fixing agents to overcome electrostatic repulsion from the anionic cellulose fibers. Cationic dyes such as basic and cationic direct dyes will be electrostatically attracted to the anionic cellulose fibers, but may still require fixing agents to achieve acceptable substantivity and affinity.

Pigments have not enjoyed the field of coloring paper about 60% of the paper market, and acid dyes and pigments make up the remainder. See Murray, "Dyes and fluorescent Whitening Agents for Paper," *Paper Chemistry* 161-192 (2d ed. 1996). This lack of market penetration may be explained by the fact that pigments do not contain solubilizing functional groups and have little affinity for or substantivity to cellulose. In particular, the addition of a fixing agent, such as cationic starch, aluminum sulfate (alum) and cationic polymers, is typically required to fix pigments to cellulose fibers.

Aluminum sulfate is the most common fixing agent for pigments and can also serve as an acidic sizing agent. However, neutral sizing agents have gained in popularity over acidic sizing agents, and aluminum sulfate can interfere with neutral sizing agents.

An object of the invention is to provide a method for coloring cellulosic materials using an aqueous pigment dispersion which does not require fixing agents or alum.

A feature of the method of the present invention is the use of a cationic dispersion containing at least one pigment, water, and at least one dispersing agent comprising a acid salt of a styrene maleimide imide resin to color cellulosic materials such as paper.

An advantage of the method of the present invention is that it permits consistent coloring of cellulosic material over time, which is important in continuous and semi-continuous papermaking operations.

Yet another advantage of the method of the present invention is that it exhibits essentially 100 percent, rapid exhaustion of the pigment particles into the cellulosic material, and thus generates clear backwaters. This is vitally important both from an economical and environmental vantage point.

SUMMARY OF THE INVENTION

In one aspect, the present invention relates to a method of coloring a cellulosic material, which includes a) dispersing pulped cellulosic material into water; and b) coloring the pulped cellulosic material by adding a cationic dispersion to the water, where the dispersion includes:

(i) at least one pigment;

(ii) water; and (iii) at least one acid salt of a styrene maleimide imide resin in an amount effective to disperse the pigment.

In another aspect, the present invention relates to a colored cellulosic material, consisting essentially of pigment particles coated with a styrene maleimide imide resin; the coated particles fixed on fibers of a cellulosic material.

In yet another aspect, the present invention relates to a cationic dispersion, which includes (i) at least one pigment;

(ii) at least one dispersing agent comprising a acid salt of a styrene maleimide imide resin; and (iii) water.

DETAILED DESCRIPTION OF THE PREFERRED EMBODIMENTS

Inorganic and organic pigments may be used in the cationic dispersion of the present invention. Suitable inorganic pigments include red oxide, yellow oxide, black iron oxide, cobalt blue, carbon black and bismuth vanadate (yellow 184).

Suitable organic pigments may be chosen from azo pigments, such as azo lake, azo chelate and condensed azo pigments, and polycyclic pigments such as phthalocyanine pigments, perylene pigments, perinone pigments, anthraquinone pigments, quinacridone pigments, dioxazine pigments, thioindigo pigments, isoindolinone pigments, quinophthalone pigments, rhodamine pigments, arylide pigments, diarylide pigments and naphthol red pigments. Preferred organic pigments include phthalocyanine green, phthalocyanine blue, carbazole violet, toluidine red, perylene red, quinacridone red, quinacridone yellow, quinacridone violet, arylide yellow, Dalamar yellow, Watchung red, and diketopyrrolopyrrole (DPP red).

The cationic dispersion of the present invention comprises at least one acid salt of a styrene maleimide imide resin. Styrene maleimide imide resins may be prepared by reacting a styrene maleimide resin with a primary diamine, such as dimethylaminopropylamine, to form a styrene maleimide imide having tertiary amine functional groups. Further details on these styrene maleimide imide resins are found in "Technical Information-Styrene Maleimide Resins SMA X 1000 I, X 2000 I, X 3000 I, X 4000 I," ELF ATOCHEM Brochure (1998), the disclosure of which is incorporated by reference herein in its entirety.

It is possible to prepare copolymer resins having a styrene/maleimide ratio ranging from 1/1 to 1/4 depending on the base resin employed in the imidization reaction. A particularly preferred styrene maleimide imide resin is prepared by reacting dimethylaminopropylamine with a styrene maleimide resin, commercially available from ATOFINA Chemicals, Inc., Philadelphia, Pa. (formerly known as Elf Atochem, Inc.). Imidization can be performed using a non-reactive diluent, the desired amine, and the styrene maleimide resin. Typical reaction conditions are 150-180° C. for 30-40 minutes. The generalized reaction scheme is set forth below:

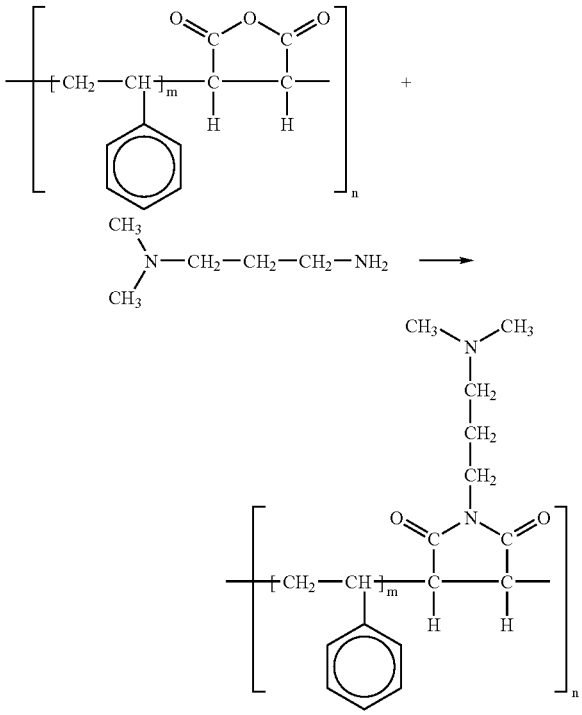

where n may be 1-3 and m is 6-8.

These styrene maleimide imide resins are insoluble in water. However, they may be converted to their corresponding acid salts, which are water soluble, by reaction with a weak acid. The weak acid may have an acid dissociation constant Ka of $1\times10^{-2}$ to $1\times10^{-7}$. Illustrative preferred weak acids include acetic acid, citric acid, hydrofluoric acid, oxalic acid and nitrous acid. The pH of the cationic dispersion is less than 7, preferably between 4 and 6.

The cationic dispersion of the present invention may be prepared by a three-stage process. In the first stage, the pigment, styrene maleimide imide acid salt, and water, together with andy desired optional additives such as a surfactant and/or biocide, are mixed together in the desired amounts to form a dispersion premix. Conventional high speed equipment may be used without modification. A mixing speed of from 500 to 10,000 rpm for a time period of from 1 minute to 2 hours, preferably 10-25 minutes, may be used depending on the size of the batch. One of ordinary skill in the art will readily understand that the dispersion of the present invention can also be prepared using a styrene maleimide resin rather than its corresponding acid salt, if a weak acid is also added to solubilize the styrene maleimide imide resin per se.

Other additives may be present in any amount which does not detract from the cationic dispersion's cellulosic materials such as paper. Suitable additives include viscosity control agents, surfactants and biocides. Suitable viscosity control agents include hydroxyalkyl celluloses, such as hydroxyethylcellulose, which are preferably added to the cationic dispersion to increase its viscosity to a 10,000 centipoise, preferably 1,000 to 2,000 centipoise, at 25° C. The amount of viscosity control agent will depend on the relative amounts of dispersing agent, pigment and water forming the dispersion, and may range from 0.05% to 2% by weight of the dispersion.

One or more surfactants may optionally be added to the dispersion to aid in its manufacture if the surfactant does not create foam. For example, non-ionic surfactants having a hydrophobic/lipophobic balance (HLB) less than 13, also known as grind aids, may be added to the dispersion to decrease milling time by reducing the surface tension of the pigment/water interface. An illustrative grind aid is an acetylenic diol with an HLB of 3 which is commercially available under the trademark SURFYNOL 104 from Air Products, Inc., Allentown, Pa.

Surfactants may also be added to the cationic dispersion to reduce foaming during mixing of the dispersion. Suitable defoaming agents include mineral oils, silicone polymers and acetylenic diols. A defoaming agent comprising a mixture of dipropylene glycol and tetramethyl-6-dodecyne-5,8-diol, commercially available from Air Products, Inc. under the trademark DF110D, is preferred. A concentration of about 0.1 weight percent is normally sufficient to ensure the dispersion does not foam during mixing. A biocide may also be added to the cationic dispersion. Suitable biocides include octhilinone, bromonitroalcohol, formaldehyde and formaldehyde-based derivatives. A concentration of about 0.1 weight percent is normally sufficient to ensure no harmful or objectionable bacteria colonize the dispersion.

The cationic dispersion of the present invention may be prepared by a three-stage process. In the first stage, the pigment, styrene maleimide imide acid salt, and water, together with any desired optional additives such as a surfactant and/or biocide, are mixed together in the desired amounts to form a dispersion premix. Conventional high speed equipment may be used without modification. A mixing speed of from 500 to 10,000 rpm for a time period of from 1 minute to 2 hours, preferably 10-25 minutes, may be used depending on the size of the batch. One of ordinary skill in the art will readily understand that the dispersion of the present invention can also be prepared using a styrene maleimide resin rather than its corresponding acid salt, if a weak acid is also added to solubilize the styrene maleimide imide resin per se.

In the second stage, the dispersion premix is media milled, typically using ceramic, metal or glass beads, to reduce pigment agglomerates to primary particles, thereby forming a non standardized dispersion. Media milling can be performed using conventional milling equipment without modification.

In the third and final stage, water is added to the non-standardized dispersion until the color of the dispersion matches a color standard. Generally from 5 to 10% by weight water is required to standardize the dispersion.

The cationic dispersion of the present invention may be used to color cellulosic materials such as paper and cotton using conventional techniques and apparatus. For example, the cationic dispersion may be added to conventional paper pulp, such as mechanical pulp or chemical pulp, as it is being made into paper. Thus, for example, from 0.05% to 10% by weight, preferably 2-3% by weight, of the cationic dispersion may be added to an aqueous solution of paper pulp, and homogenized for a time sufficient to completely exhaust the pigment into the cellulosic fibers of the paper prior to paper sheet formation.

The styrene maleimide imide acid salt is only soluble in an acidic solution, and becomes insoluble in an alkaline environment. Those of ordinary skill in the papermaking arts know that water quality can vary tremendously, particularly if river water is used rather than municipal water; In particular, pH can range from 4 to 9. Accordingly, it may be necessary to monitor and, if necessary, adjust the pH below 7 to ensure optimum performance of the cationic dispersion.

Without intending to be bound by theory, the inventors currently believe that the cationic styrene maleimide imide acid salt coats the pigment particles, thereby allowing them to disperse in water. When the dispersion is mixed with an aqueous solution of anionic cellulosic materials such as paper pulp, the cationic styrene maleimide imide acid salt is electrostatically attracted to the anionic, partially dissociated carboxylic groups of the cellulosic fibers, fixing the coated pigment thereon.

The method of the present invention provides a colored cellulosic material which does not require a fixing agent for the pigment. Yet another advantage of the essentially complete exhaustion of the pigment into the cellulosic material and a correspondingly clear backwater.

EXAMPLES

The following examples illustrate preferred embodiments of the invention, and are not intended to limit the scope of the invention in any manner whatsoever.

Example 1

Formulation of a Cationic Dispersion Containing Blue Pigment

A high speed mixer was used to mix acetic acid, phthalocyanine blue pigment, styrene maleimide imide resin (SMA x 2000 I, commercially available from ATOFINA Chemicals, Inc., Philadelphia, Pa.), a defoaming agent comprising a mixture of dipropylene glycol and tetramethyl-6-dodecyne-5,8-diol, commercially available from Air Products, Inc. under the trademark DF110D, a biocide comprising octhilinone, commercially available from Thomson Research Associates, Toronto, Canada, under the trademark ULTAFRESH DM-25, and water to form a dispersion premix, which was then media milled (Eiger mixer) to disperse and incorporate the pigment into the dispersion had a total solids percentage of percentage of 48.7. The weight percentage composition of this cationic dispersion is set forth below in Table 1:

TABLE 1

| MATERIALS | WEIGHT PERCENTAGES |
|---|---|
| Styrene Maleimide Imide | 5.50 |
| Pigment (Phthalo Blue) | 43.00 |
| Weak Acid (Acetic Acid) | 1.00 |
| Defoamer | 0.10 |
| Biocide | 0.10 |

TABLE 1-continued

| MATERIALS | WEIGHT PERCENTAGES |
|---|---|
| Water | 50.30 |
| TOTAL | 100% |

Example 2

Formulation of a Cationic Dispersion Containing Yellow Pigment

A second cationic dispersion was formulated using the general procedures of Example 1. The weight percentage composition of the resulting cationic dispersion is set forth below in Table 2:

TABLE 2

| MATERIALS | WEIGHT PERCENTAGES |
|---|---|
| Styrene Maleimide Imide | 5.50 |
| Pigment (Phthalo Blue) | 43.00 |
| Weak Acid (Acetic Acid) | 1.00 |
| Defoamer | 0.10 |
| Biocide | 0.10 |
| Water | 50.30 |
| TOTAL | 100% |

Example 3

Coloring of Paper Pulp

The cationic dispersions of Examples 1 and 2 were each individually used to color paper pulp in accordance with the following procedure: 4 grams of a 50/50 blend of hard and soft wood fibers were added to a beaker containing 100 grams of water and mixed for approximately 5 minutes using a flat mixing blade operating at a speed of at least 100 rpm to produce an aqueous suspension of cellulosic fibers.

Separately, 1 gram of the cationic dispersion was diluted with 250 grams of water. 25 milliliters of the diluted dispersion were pipetted into the aqueous suspension, which was mixed for another 5 minutes using the same mixing conditions and equipment, thus resulting in an aqueous suspension of colored cellulosic fibers.

The aqueous suspension was then put in a small sheet mold having a forming screen on the bottom, and the water was extracted, thereby forming a sheet of colored paper on the forming screen. Both of the cationic dispersions completely exhausted their pigments into the paper pulp, and gave crystal clear backwaters. The colored paper was blotted and dried on a small paper drier.

The completely dry colored paper was evaluated for color continuity, two sidedness, color matching to a standard, and color strength. Samples of colored paper made from the cationic dispersion of Example 1, and samples of colored paper made from the cationic dispersion of Example 2, passed all tests.

We claim:

1. A cationic dispersion, comprising:

(i) at least one pigment;

(ii) at least one dispersing agent which is (a) at least one acid salt of a styrene maleimide imide resin or (b) the combination of at least one styrene maleimide imide resin with at least one weak acid; and (iii) water.

2. The cationic dispersion of claim 1, wherein said pigment is at least one organic pigment selected from the group consisting of phthalocyanine green, phthalocyanine blue, carbazole violet, toluidine red, Dalamar yellow, Watchung red and diketopyrrolopyrrole.

3. The cationic dispersion of claim 2, wherein said organic pigment is a phthalocyanine.

4. The cationic dispersion of claim 1, wherein said pigment is at least one inorganic pigment selected from the group consisting of red oxide, yellow oxide, black iron oxide, cobalt blue, carbon black and bismuth vanadate.

5. The cationic dispersion of claim 1, further comprising at least one member of the group consisting of a surfactant, a biocide and a viscosity control agent.

6. The cationic dispersion of claim 1, wherein said pigment comprises primary particles.

7. A process for preparing a cationic dispersion, comprising:

(i) mixing, at 500 to 10,000 rpm, at least one pigment, water, and either (a) at least one acid salt of a styrene maleimide imide resin or (b) the combination of at least one styrene maleimide imide resin with at least one weak acid, thereby forming a dispersion premix;

(ii) milling the dispersion premix in a mixer filled with ceramic, metal or glass beads for a period of time sufficient to reduce pigment agglomerates to primary particles, thereby forming a non-standardized dispersion; and (iii) adding water to the non-standardized dispersion until it matches a color standard and forms a cationic dispersion suitable for coloring building materials.

8. The method of claim 7, wherein said pigment and water are mixed with at least one acid salt of a styrene maleimide imide resin.

9. The method of claim 7, wherein said pigment and said water are mixed with at least one styrene maleimide imide resin in combination with at least one weak acid.

10. The method of claim 9, wherein said weak acid is at least one member selected from the group consisting of acetic acid, citric acid, carbonic acid, hydrofluoric acid, oxalic acid and nitrous acid.

11. A colored building material, comprising the cationic dispersion of claim 1 dispersed in a building material.

12. The colored building material of claim 11, wherein said building material is selected from at least one member of the group consisting concrete, asphalt, plaster, mortar and cement mortar.

13. The cationic dispersion of claim 1, wherein said dispersing agent is 1-20% of the total dispersion.

14. The cationic dispersion of claim 13, further comprising at least one member of the group consisting of a surfactant, a biocide and a viscosity control agent.

15. The cationic dispersion of claim 1, wherein said pigment is at least one pigment selected from the group consisting of phthalocyanine green, phthalocyanine blue, carbazole violet, toluidine red, Dalamar yellow, Watchung red, diketopyrrolopyrrole, quinacridone red, quinacridone yellow, quinacridone violet, arylide yellow, red oxide, yellow oxide, black iron oxide, cobalt blue, carbon black and bismuth vanadate.

16. The cationic dispersion of claim 15, wherein the dispersion further comprises at least one member of the group consisting of a surfactant, a biocide and a viscosity control agent.

17. The cationic dispersion of claim 16, wherein said dispersing agent is 1-20% by weight of the total dispersion.

18. The cationic dispersion of claim 17, wherein said dispersing agent is 3-8% by weight of the total dispersion.

19. The cationic dispersion of claim 13, wherein said dispersing agent is 3-8% by weight of the total dispersion.

* * * * *